US010100391B2

(12) United States Patent
Kuznetsov et al.

(10) Patent No.: US 10,100,391 B2
(45) Date of Patent: Oct. 16, 2018

(54) PROCESS FOR HEAT TREATMENT OF PARTS MADE FROM LOW AND SPECIFIED HARDENABILITY STRUCTURAL STEEL

(76) Inventors: Anatoly Alexeevich Kuznetsov, Moscow (RU); Arkady Moissevich Peker, Odintsovo Moskovskaya (RU); Alexey Alexandrovich Kupriyanov, Moscow (RU); Sergey Ivanovich Nikitin, Moscow (RU)

( * ) Notice: Subject to any disclaimer, the term of this patent is extended or adjusted under 35 U.S.C. 154(b) by 1117 days.

(21) Appl. No.: 13/991,961

(22) PCT Filed: Apr. 28, 2011

(86) PCT No.: PCT/RU2011/000279

§ 371 (c)(1),
(2), (4) Date: Oct. 6, 2014

(87) PCT Pub. No.: WO2012/091613

PCT Pub. Date: Jul. 5, 2012

(65) Prior Publication Data

US 2015/0232969 A1 Aug. 20, 2015

(30) Foreign Application Priority Data

Dec. 31, 2010 (RU) ..... 2010154543

(51) Int. Cl.
*C21D 1/06* (2006.01)
*C22C 38/58* (2006.01)
(Continued)

(52) U.S. Cl.
CPC ..... *C22C 38/58* (2013.01); *C21D 1/06* (2013.01); *C21D 1/18* (2013.01); *C21D 6/004* (2013.01);
(Continued)

(58) Field of Classification Search
CPC ... C21D 1/06; C21D 1/19; C21D 1/10; C21D 1/18; C21D 1/20; C21D 1/22
See application file for complete search history.

(56) References Cited

U.S. PATENT DOCUMENTS 6,270,595 B1 * 8/2001 Takayama ..... C21D 9/14 148/570
6,364,974 B1 * 4/2002 Kobasko ..... C21D 1/18 148/320
(Continued)

OTHER PUBLICATIONS

ERS Engineering Corporation—Breakthrough Contour Hardening Through Surface Hardening "SH" Technology.
(Continued)

*Primary Examiner* — Matthew E. Hoban
(74) *Attorney, Agent, or Firm* — John R. Benefiel

(57) ABSTRACT

A size hardening heat treatment process for steel parts of a plate, cylindrical or spherical shape and using low or specified hardenability steel compositions which are through surface heated and very rapidly quenched to produce case hardening of the part. A set of graphs are provided which depict the relationship between the depth of hardening and the dimension of the part for each of a series of critical, i.e., ideal diameter values which allow producing a depth of hardening of a particular part by a proper selection of the DI value of the part. The DI values are calculated by a formula which allows a range of DI values to be created by varying the components of the steel as set out in the formula. The formula also insures a fine grain size to be created by the process to prevent cracking by the very rapid quenching required. A list of elements allowed in the steel but limited by a % mass set out for each component. A particular depth of hardening desired can be produced for a given part of a shape and dimension appearing in the graphs by composing the steel so that the DI is that critical which will produce the
(Continued)

desired depth of hardening when the part is heated by through the surface heating and then very rapidly quenched.

6 Claims, 7 Drawing Sheets

(51) Int. Cl.

| | |
|---|---|
| ***C21D 9/36*** | (2006.01) |
| ***C21D 9/46*** | (2006.01) |
| ***C21D 9/52*** | (2006.01) |
| ***C21D 6/00*** | (2006.01) |
| ***C21D 1/18*** | (2006.01) |
| ***C22C 38/54*** | (2006.01) |
| ***C22C 38/50*** | (2006.01) |
| ***C22C 38/46*** | (2006.01) |
| ***C22C 38/44*** | (2006.01) |
| ***C22C 38/42*** | (2006.01) |
| ***C22C 38/34*** | (2006.01) |
| ***C22C 38/06*** | (2006.01) |
| ***C22C 38/04*** | (2006.01) |
| ***C22C 38/02*** | (2006.01) |

(52) U.S. Cl.
CPC ..... *C21D 6/005* (2013.01); *C21D 6/008* (2013.01); *C21D 9/36* (2013.01); *C21D 9/46* (2013.01); *C21D 9/525* (2013.01); *C22C 38/02* (2013.01); *C22C 38/04* (2013.01); *C22C 38/06* (2013.01); *C22C 38/34* (2013.01); *C22C 38/42* (2013.01); *C22C 38/44* (2013.01); *C22C 38/46* (2013.01); *C22C 38/50* (2013.01); *C22C 38/54* (2013.01)

(56) References Cited

U.S. PATENT DOCUMENTS

2010/0047106 A1* 2/2010 Saitoh ..... C21D 1/06 420/83
2011/0253265 A1* 10/2011 Fujihara ..... C21D 1/18 148/519

OTHER PUBLICATIONS

Contour Hardening Bevel, Hypoid, and Pinion Gears. By Semyon Bray, Anatloy Kuznetsov, Sergey Niktin, Bob Binoniemi, and Valery Rudnev. Sep. 2011.

* cited by examiner

PROCESS FOR HEAT TREATMENT OF PARTS MADE FROM LOW AND SPECIFIED HARDENABILITY STRUCTURAL STEEL

BACKGROUND OF THE INVENTION

The invention refers to hardening heat treatment of the perlite-class steel.

A process of (TSH) heat treatment—is known where the selection or development of the steel chemical composition was frequently based on the necessity requirement to ensure both through- and surface thermal hardening of the part by alloying so as to increase hardenability; or the ability of the steel to harden in weak cooling media to prevent crack formation. Alloying is also less frequently used to improve the steel quality features compared to carbon steels—i.e., to increase strength, plastic and dynamic properties, heat resistance, lower the cold brittleness threshold, etc.

A process of surface hardening with deep induction heating is known, now called through-surface hardening.

It was also known that many mechanical properties can be achieved using the low (LH) and specified hardenability (SH) carbon- and low-alloy steels.

These are steels whose hardenability complies with the effective loaded cross-section of the part; in this case, following TSH, the surface layers of this cross-section, i.e., 0.1-0.2 of the diameters (thickness), have a martensite structure with HRC=60 hardness, while the core hardness is HRC=30-45.

Steel hardenability corresponds to the ideal diameter (DI) value of the steel that actually defines the optimum hardened layer depth with reference to the specific part shaped as a cylinder, sphere or plate.

In principle, LH and SH steels are used for the same purpose and just conventionally differ only by the ideal diameter (DI) value: for LH steels as in the earlier products, this diameter is equal to 8-16 mm, whereas for modern SH steels it is over 16 mm.

The necessary DI range of LH and SHI steels for a specific type of parts was achieved in an improvement by a combined restriction in the upper limit of one or a group of added elements which led to a lower accuracy and a wider DI range.

A disadvantage of the LH steels (see patent RU 2158329) is that the specified low hardenability value was achieved only by a strict limitation of all permanent elements—Mn, Si, Cr, Ni, Cu, which made smelting more difficult and resulted in lower DI range accuracy during the development of the chemical composition and, as a consequence, led to a wider deviation in the hardened layer depth and exceeded tolerance ranges.

For example, LH steel with 0.8% C and containing Mn, Si, Cr, Ni, Cu (<1% each and 0.06-0.12% Ti (LH steels)—(see patent RU 2158320) has minimal hardenability—DI<12 mm for austenite size 10 grain and finer grain (#11) DI<11 mm and <10 mm for #12 grain size, whereas similar steel with 0.8% C; 0.05% Mn; 0.12% Si; 0.11% Cr, 0.25% Ni; 0.3% Cu; 0.05% Al; 0.22% Ti (with a wider range of Ni, Cu) has the same DI value.

The object of this invention is to provide a process for heat treatment during induction and furnace heating using LH and SH steels which avoid the disadvantage described.

Another object is to obtain an even finer austenite grain ##11-13 GOST5639 (ASTM), more stable preset hardenability level (DI), with a substantially smaller deviation and which strictly corresponds to the depth of the hardened layer obtained on parts subjected to heat treatment using the proposed procedure an improved process, the capability of treating thinner, smaller parts with the through-surface and through-thickness hardening.

SUMMARY OF THE INVENTION

A process in which the content of the steel used to make a part has a % weight limit for each of a list of elements.

A formula is also provided including some of those of the listed elements which affect hardenability and from which the ideal diameter (DI) of the steel including some of those elements can be computed.

The invention provides graphs shown in the Figures which depict a relationship between the computed DI of the steel and the relationship between the part thickness for cylindrical, spherical and plate shapes and the depth of hardening produced by a very rapid cooling of a through the surface heated part.

Thus, steel of a composition having a DI for a given part shape will produce a desired depth of case hardening of a part thickness can be used to make the case hardened part.

DETAILED DESCRIPTION

Figure 1A:
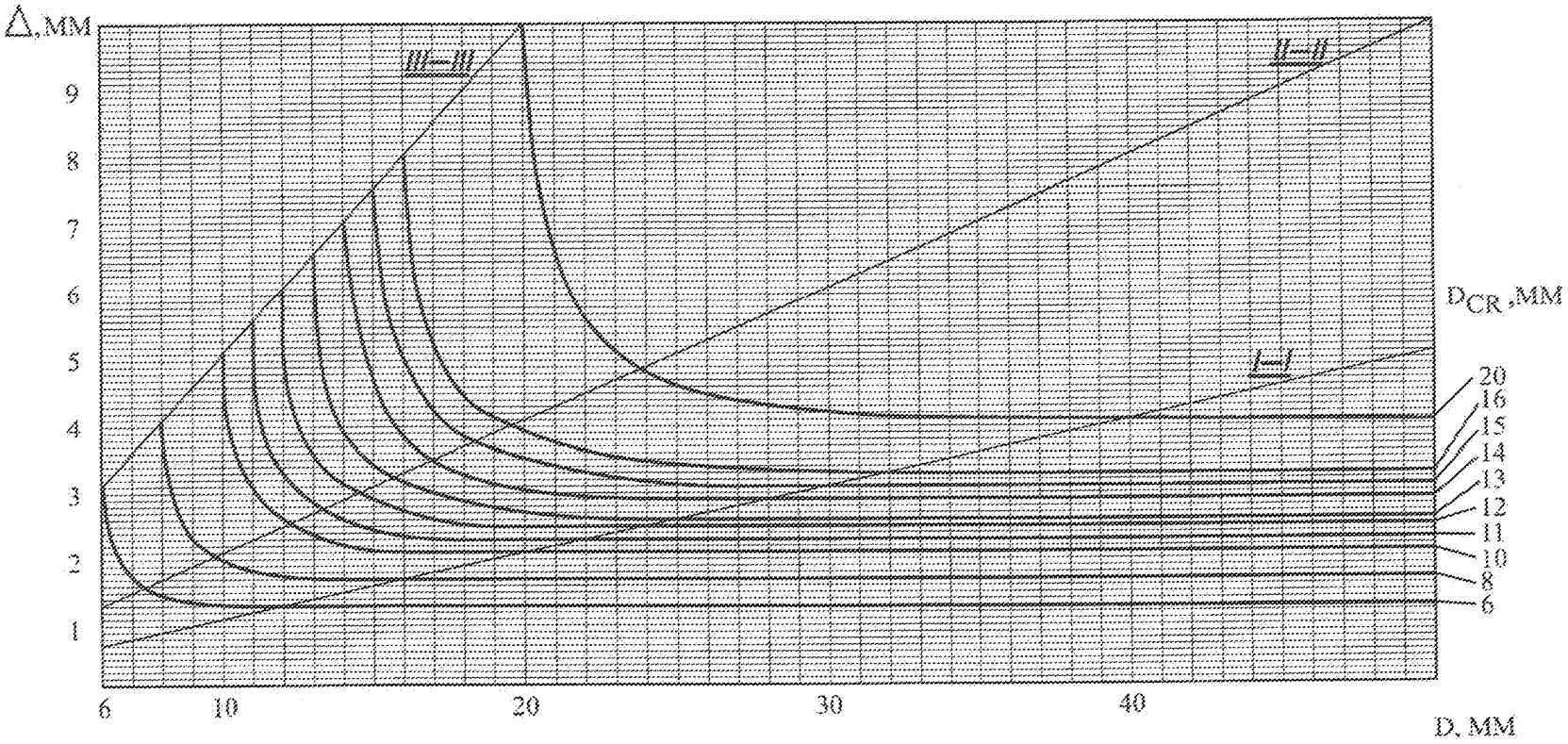
FIG. 1A a graph depicting the relationship between a hardened layer depth (Δ) and a diameter (D) of a cylinder for each of a low range series of critical (ideal) diameter (Dcr) values (mm) of steel.

To achieve these objects, a process for heat treatment of parts made from low (LH) and specified (SH) hardenability structural steel is provided for parts shaped as a sphere, cylinder, or plate, including through-surface hardening by through-surface heating of the part or its effective cross-section, up to the temperatures of austenitization and cooling provided with a liquid refrigerant at the rate of more than 40,000 kcal/m$^2$·H. ° C. and than tempering. The parts are made from steel in which all of the following components if present are limited by the weight % noted:

| | |
|---|---|
| Carbon | .15-1.2 |
| Manganese | not more than 1.8 |
| Silicon | not more than 1.8 |

-continued

| | |
|---|---|
| Chrome | not more than 1.8 |
| Nickel | not more than 1.8 |
| Molybdenum | not more than .5 |
| Tungsten | not more than 1.5 |
| Boron | not more than .007 |
| Copper | not more than .3 |
| Aluminum | .03-0.1 |
| Titanium | not more than .4 |
| Vanadium | not more than .4 |
| Nitrogen | not more than .1 |
| Zireonium | not more than .4 |
| Calcium | net more than .03 |
| Sulphur | not more than .035 |
| Phosphorus | not more than .035 |
| Iron and unavoidable Admixtures | Rem. |

The ideal diameter DI is calculated by the following mathematical expression (referred to therein as the critical diameter (Dcr):

$$Dcr=K\sqrt{C}\cdot(1+4.1\cdot Mn)\cdot(1+0.65\cdot Si)(1+2.33\cdot Cr)(1+0.52\cdot Ni)(1+)0.27\cdot Cu)\cdot(1+3)0.14(1+1.05\cdot W)\cdot[1+1.5(0.9-C]\cdot(1-0.45C')\cdot(1-0.3Ti)\cdot(1-0.35V)\cdot(1-0.25Al),$$

wherein Dcr is the ideal diameter (DI), in mm, wherein K is a coefficient whose value depends on the actual austenite grain size in the range of ##6-13 according to the ASTM scale, GOST'5639, and is, respectively, equal to: 5.4 for #13 grain, 5.8 for #12 grain; 6.25 for #11 grain; 6.75 for #10 grain; 7.3 for #9 grain; 7.9 for #8 grain; 8.5 for #7 grain; 9.2 for #6 grain;

wherein C, Mn, Si, Cr, Ni, Cu, Mo, W are components by weight % which are limited as noted if, contained in the austenite solid solution at the final heating temperature preceding hardening cooling;

wherein (1+1.5(0.9-C] is the multiplicand taken into account only if boron is present in the steel in the amount of 0.002-0.007%;

wherein C', Ti, V, Al are components which while being limited are weight %, not contained in the austenite solid solution, but present in the form of structurally-free secondary carbonitride phases at the final heating temperature preceding hardening cooling, in which case C' is the mass % of carbon content in excessive hypereutectoid steel cemenite;

in which case, the surface hardened layer depth is determined from graphs showing the depth as a function of the cylinder diameter, sphere diameter, or plate thickness and the ideal (critical) diameter as calculated by the above formula.

Structural steel with the specified chemical composition according to the formula and with the same grain size has the following ideal diameter (DI) ranges:

6-15 mm DI—with a deviation of not greater than 2 mm;

16-50 mm DI—with a deviation of not greater than 5 mm;

51-100 mm DI—with a deviation of not greater than 10 mm;

Over 100 mm DI—with a deviation of not greater than 50 mm.

To prevent hot-brittleness, the total content of manganese and titanium in the structural steel should be more than six times the maximum sulfur content.

To prevent hardening cracks, the part is made from steel containing carbon in the amount of <0.3 weight % is heated to ensure the actual austenite grain size of not greater than #6.

To prevent hardening cracks, the part is made from steel containing carbon in the amount of <0.3 weight % is heated to ensure the actual austenite grain size of not greater than #11.

To prevent hardening cracks, the part is made from steel containing carbon in the amount of <0.3 weight % is heated to ensure the actual austenite grain size of not greater than #8, cooling is done with multiple self-tempering at 150-300° C. for 1.0-30 seconds.

To prevent hardening cracks, the part made from steel containing carbon in the amount of <0.3 weight % is heated to ensure the actual austenite grain size of not greater than #8, cooling is done with multiple self-tempering at 150-300° C. for 1.0-30 seconds.

After hardening, the part is subjected to tempering during heating in the furnace at 150-300° C.

After hardening, the part is subjected to tempering at over 300° C., i.e. the above the temperatures of total decomposition of martensite within the surface hardened layer into a thin quasi-eutectoid structure—troostite, troostosorbite, sorbite capable of being tempered to HRC 25-50, with preservation of a pearlite-sobite hardening structure in the core.

A feature of the proposed steel heat treatment process is that the ultimate concentration, in the steel, of some indicated elements that drastically increase hardenability can be limited to 0-0.005% or 0-0.1%, whereas that of other, weaker ones, can be increased to the range of 0-0.3% and, in some cases, to 0-0.5% without any deterioration in quality. This simplifies selection of the initial charge during smelting and thereby makes the steel less expensive. Since ultimately the pre-specified calculated DI value obtained by combining the composition of the residual elements after steel deoxidation with the amount of alloying elements added as per the formula that is based on the classical method of calculating hardenability as per Grossman and which is most acceptable for LH and SH steels. Practical experience has confirmed its accuracy for parts of various shapes and sizes.

However, this calculation has been refined by present inventors as a further improvement. Thus, in the formula, the range of the K-coefficient that depends on the austenite grain size was extended up to #11, 13. Multiplicands for hardenability as a function of tungsten and boron were additionally introduced. Multiplicands were introduced for the ideal diameter as a function of modifying elements of secondary carbonitride phases that do not enter the austenite solid solution prior to hardening cooling, i.e. titanium, vanadium, aluminum, carbon present in the structurally-free cemenite of hypereutectoid steels, and suphur and phosphor were excluded from the formula since their content in the above specified limited amounts does not have any practical effect on the ideal diameter (DI) value calculated using the formula.

Under the circumstances, primarily from an economic point of view, addition of the specified amount of manganese is expedient, as the most effective and relatively inexpensive component, alone, or along with inexpensive silicon in the amounts of 0-1.8% of each instead of more expensive ones that had been in the past added to the steel in order to increase hardenability.

The qualitative addition of boron to the steel in very small amounts of 0.003-0.005% also leads to an increase in hardenability, which becomes even more effective as the content of carbon in steel decreases (according to the formula). Using the formula during the development of the steel chemical composition provides for optimal, rather than excessive, alloying of the steel.

Therefore, addition of other alloying elements—Cr, Ni, in the amount of 0-0.5% only for bringing steel hardenability (DI) up to the required level, is not necessary since it will not practically change the mechanical properties compared to their lower content or complete absence with the same DI value and austenite grain size.

Addition of other alloying elements, % by weight—titanium in the amount of not more than 0.4%, vanadium not more than 0.4% aluminum—0.03 —, 1%, nitrogen—not more than 0.1%, present in steel in the form of finely dispersed carbides and nitrides insignificantly dissolved in austenite helps to reduce grain size, widen the optimal temperature range when heating prior to hardening, improve strength and plastic properties of the 3$^{rd}$ generation LH and SH steels produced by the process of this invention. In this case, the total content of manganese and titanium should be more than six times the maximum sulfur content, since titanium, like manganese, binds sulphur into high-melting sulfides.

The addition of other alloying elements may be done within the limits of weight % given, i.e.,—chrome, nickel in the amounts of not more than 0.6% (not more than 1.8% of each), molybdenum and tungsten (not more than 0.5% Mo and not more than 1.5% W), individually or together selectively (as a complex), also in compliance with the above formula in order to achieve a specified calculated DI value and to improve quality properties, i.e., improve mechanical properties, heat resistance, lower the cold brittleness threshold, etc.

Given below is the reason for the limits of these elements in the chemical composition of LH and SH steels used for the hardening process:

1. The ultimate manganese content of 1.8 weight % is determined by steel is susceptibility to overheating when its content is higher, excessive content of silicon, i.e. above 1.8-2.0 by weight % is fraught with steel changing from perlite class to ferrite class that is insusceptible to strengthening by hardening.

2. Chrome content for perlite class steels should not be in excess of 1.8-2.0 by weight % due to the resulting higher brittleness of the martensite-structured hardened layer.

3. The maximum content of nickel in the amount of 1.8-2.0 by weight % is selected based on its high cost compared to that of manganese, silicon, chrome and relative low increase in its hardenability factor (0.52). In addition, the austenite grain size reduction to #10-13 for the steel results in a substantial increase in ductility and viscosity which excludes the any benefit of nickel with subsequent increase in its quantity.

4. Copper is usually a practically non-removable element, its maximum content is usually limited to 0.25%, which for the proposed steel, can, in some cases, be increased to 0.3-0.5 by weight % without affecting the quality and should be taken into account during weighted alloying of steel.

5. Molybdenum and tungsten are expensive components, as well, and are also added to the steel in weighted amounts, along with chrome and nickel mostly to increase its heat resistance; exceeding the content limit 0.5 weight % for molybdenum ad 1.5 mass % for tungsten, can, even with small amounts of manganese and chromes, result in the steel changing to the martensite class, i.e, in through-hardening irrespective of the part size.

6. Sulphur and phosphor present in steel in the above-mentioned amounts do not practically affect the ideal (critical) diameters (DI) value.

7. Presence of carbide-forming elements—titanium and vanadium in the above-mentioned amounts, as well as aluminum and nitrogen that form aluminum nitride—contributes to formation of a finer austenite grain, inhibits its growth when subjected to heating prior to hardening and lowers hardenability. Under the circumstances, the lower aluminum content boundary of 0.03 weight % guarantees rather complete steel deoxidation, exceeding the upper limit of 0.1 weight % is undesirable due to the beginning of aluminum dissolution in austenite and uncontrollable growth of steel hardenability, making it more expensive.

8. Exceeding the ultimate content of nitrogen in steel—0.1 weight % will cause an irreversible congulation (coarsening) of aluminum and titanium nitrides which is analogous to titanium and vanadium carbides with the content of these elements above 0.4 weight %, all this also making the steel more expensive.

The minimal ideal diameter value of 6 mm was obtained by the inventors experimentally on LH40 steel of the following chemical composition, weight %: 0.41 C; 0.03 Mn; 0.04 Si; 0.06 Cr; 0.05Ni, 0.3 Cu, 0.05 Al; 22 Ti (the calculated DI value is 5.4 mm for #13 grain austenite).

This steel ensured formation of a 1.3 mm through-surface hardened layer on a 10 mm dia cylinder-shaped rod, 1.55 mm layer on a 15 mm dia sphere, 1.3 mm layer on an 8 mm thick plate, which practically was in compliance with the calculated data of 1.2 mm, 1.3 mm and 1.1 mm.

Further decrease in the DI to less than 6 mm leads to a drastic growth in the critical hardenability velocity (Vcr) to over 1500° C./sec, resulting in use of extremely pure steels that are free from impurities which is very difficult to achieve.

The most important distinctive feature of steels used in the process according to the invention is that during the development of the chemical composition of steel to be subjected to hardening, is that it is possible to theoretically predetermine with sufficient accuracy not only the DI value, but also the optimal hardened layer depth, as applied to the specific part in the shape of a cylinder, sphere or plate.

Figure 1B:
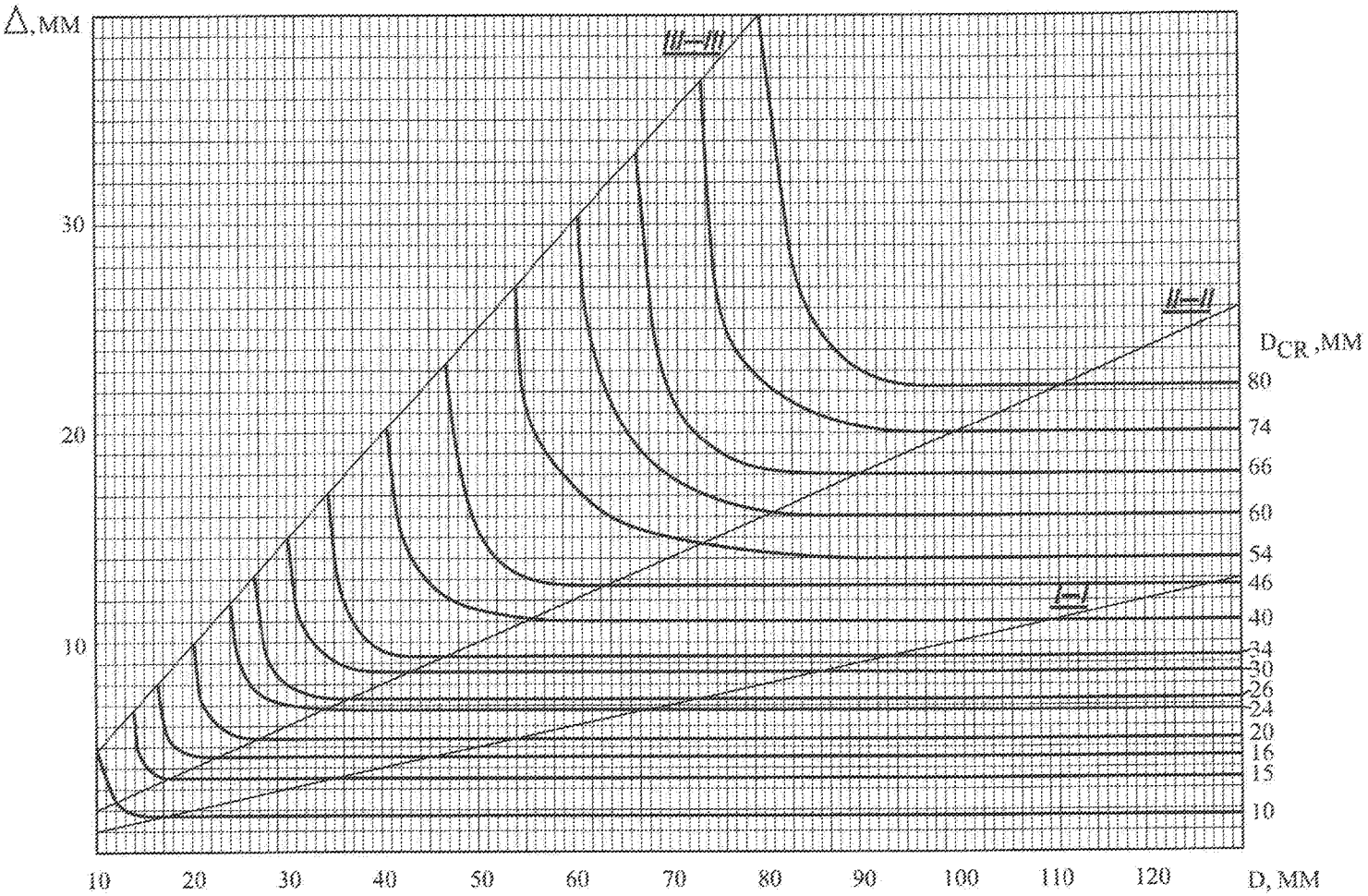
FIG. 1B is a graph depicting the relationship between hardened layer depth (Δ) and a diameter (D) of a cylinder for each of a medium range series of critical (ideal) diameter (Dcr) values of steel.
Figure 1C:
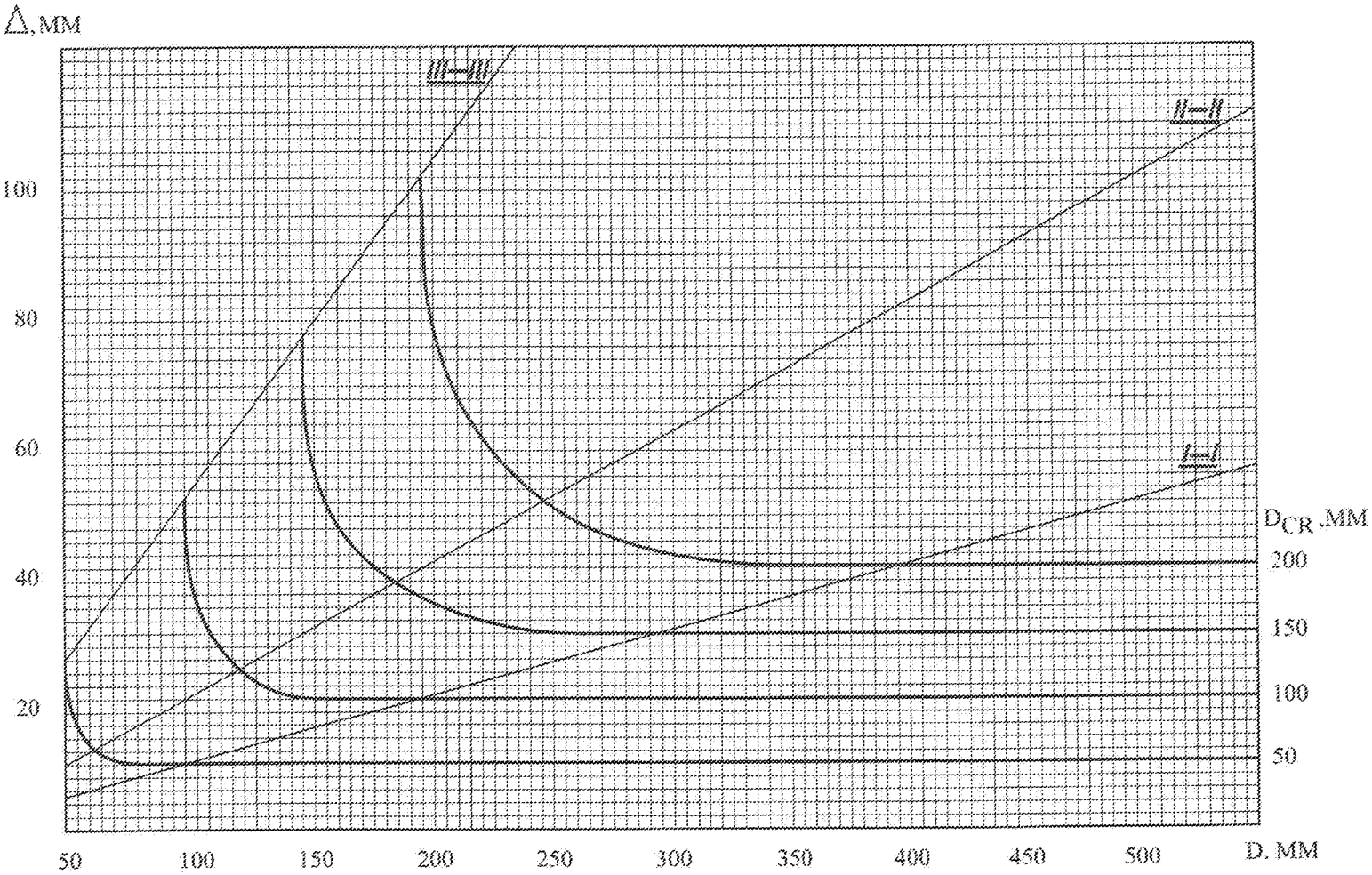
FIG. 1C is a graph depicting the relationship between hardened layer depth (Δ) and a diameter (D) of a cylinder for each of a high range of critical (ideal) diameter (Dcr) values of steel.
Figure 2A:
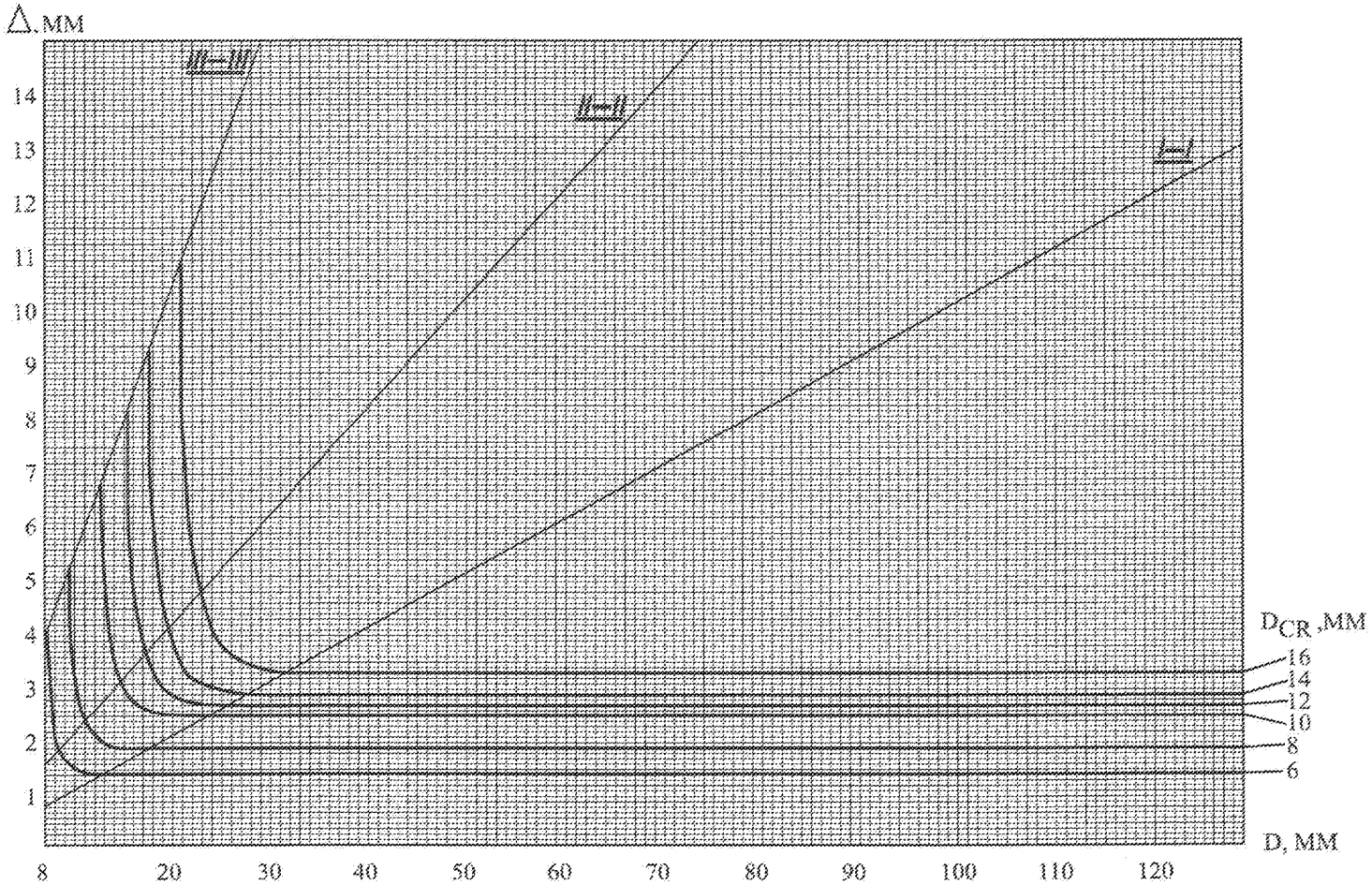
FIG. 2 is a graph depicting the relationship between hardened layer depth (Δ) and a diameter (D) of a sphere for each of a low range of critical diameter (Dcr) values of steel.
FIG. 2B is a graph depicting the relationship between hardened layer depth (Δ) and a diameter (D)) of a sphere for each of a medium range of critical (ideal) diameter (Dcr) values of steel.
Figure 2B:
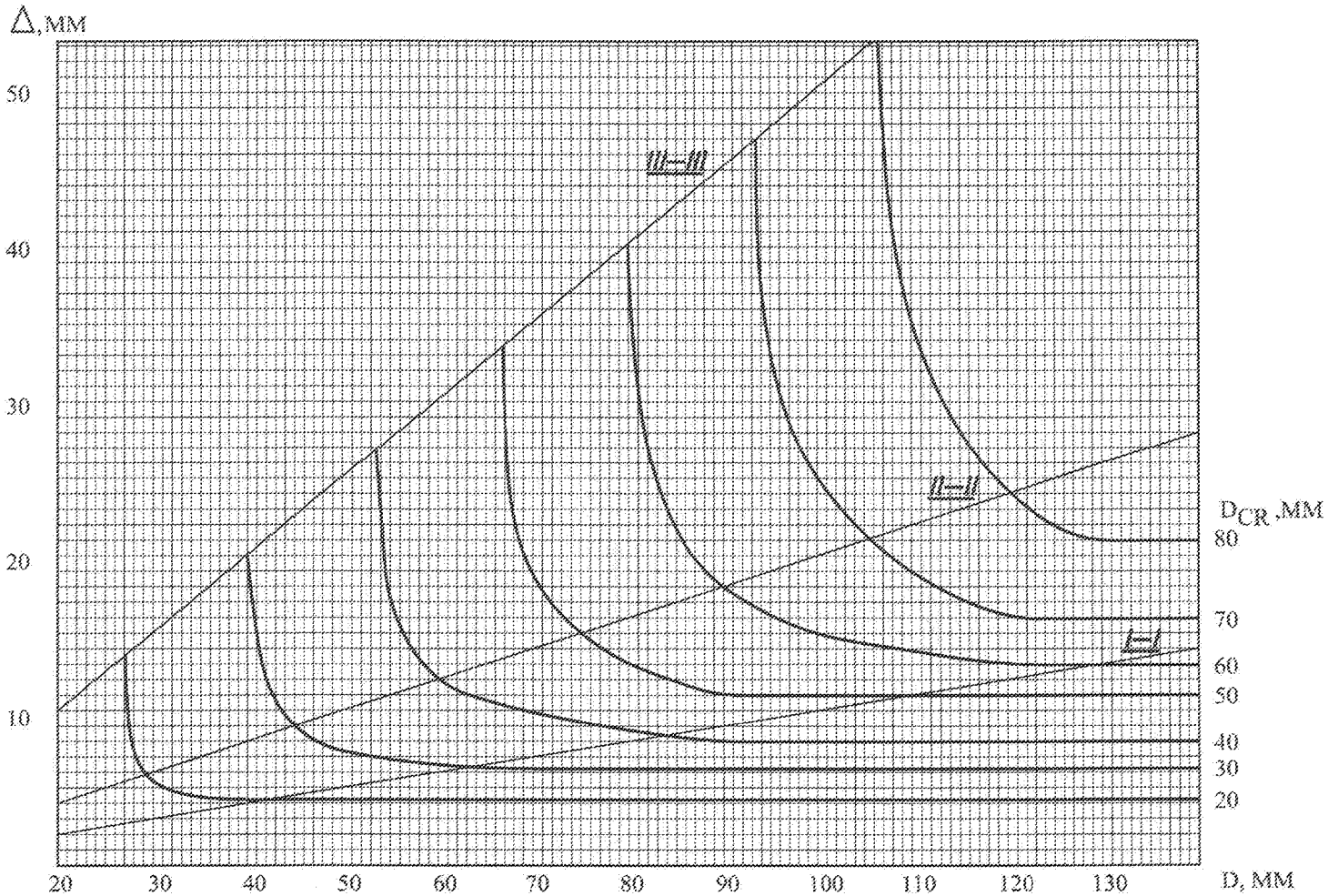
Figure 3A:
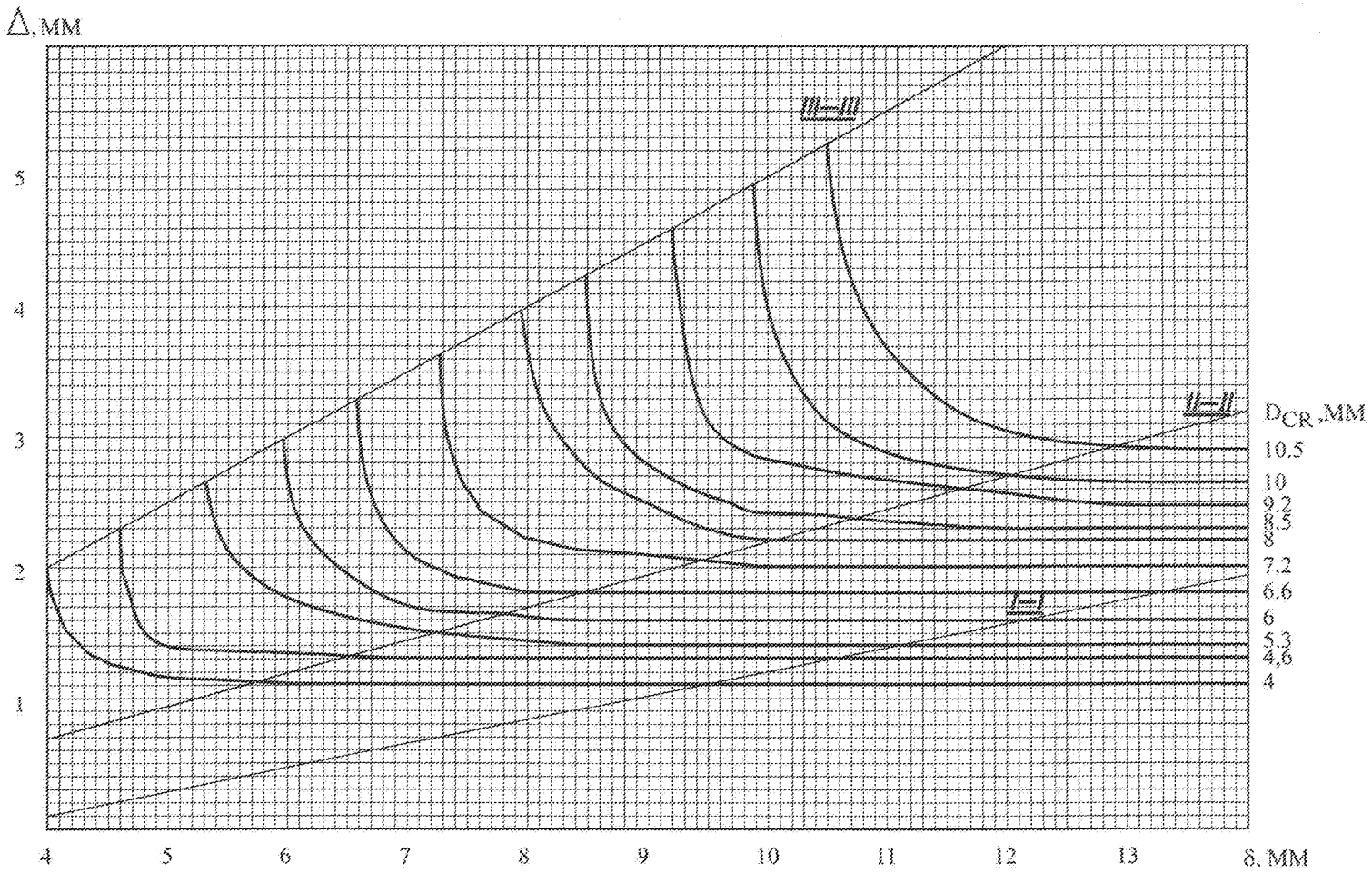
FIG. 3A is a graph depicting the relationship between hardened layer depth (Δ) and a thickness δ of plates for each of a low range of critical (ideal) diameter (Dcr) values of steel.
Figure 3B:
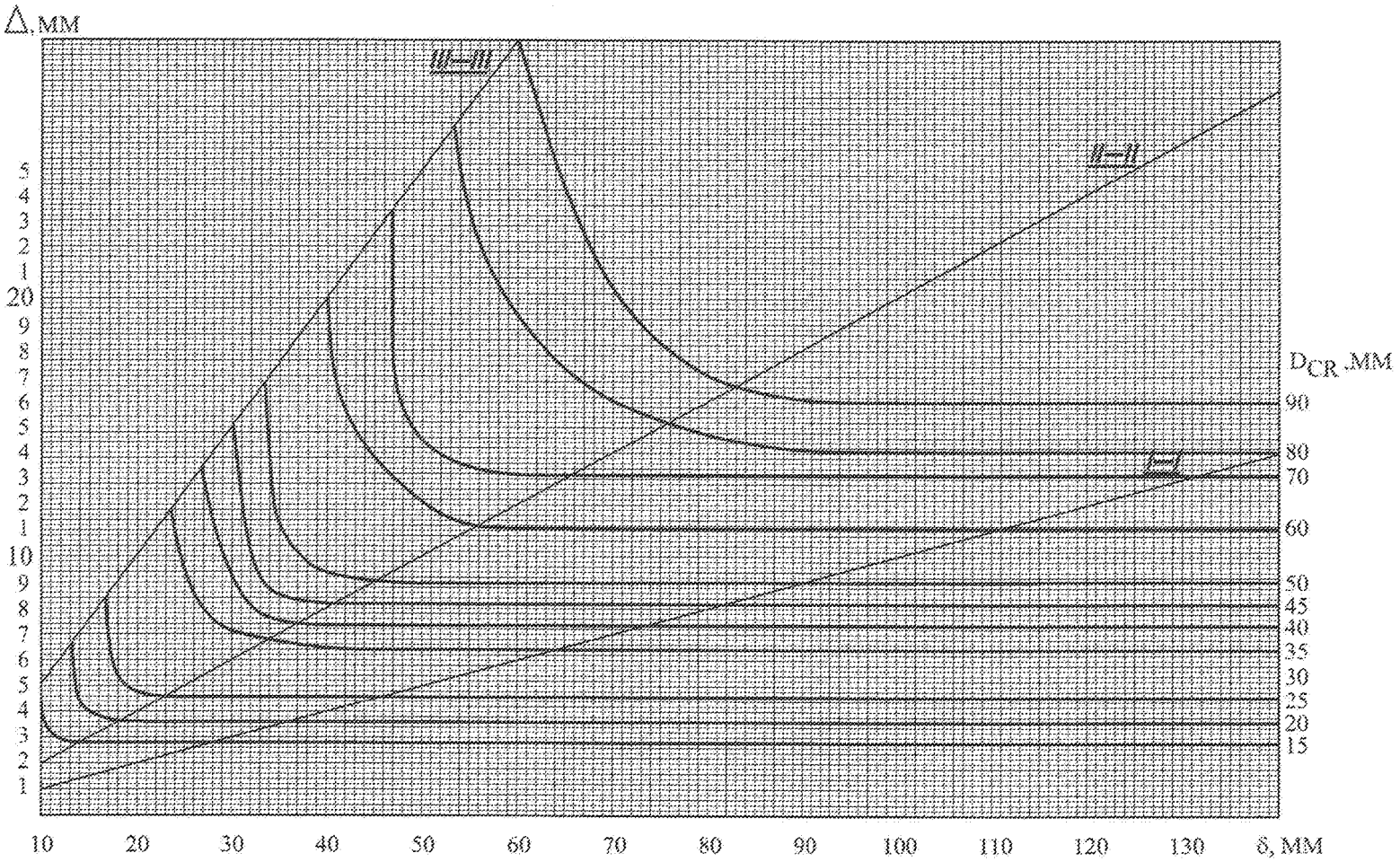
FIG. 3B is a graph depicting the relationship between hardened layer depth (Δ) and a thickness δ of plates for each of a medium range of critical (ideal) diameter (Dcr) values of steel.

For parts exposed to bending or twisting loads during operation, the hardened layer depth equal to 0.1-0.2 of the diameter (thickness), (i.e. the zone between sections I-I and II-II, see FIG. 1-3) is considered optimal and used during through-surface hardening.

However, quite often the required hardened depth can be either <1D (δ), i.e. 1.0 mm÷0.1D(δ) (the zone located below section I-I see the graphs of Figures), e.g. when hardening large-size shafts with bearings mounting surfaces during general hardening of the part, thick-wall parts of large-size ball bearings or >0.2D(δ), i.e. 0.2 D(δ)÷0.5D (δ) (the zone located between sections II-II and III-III, in the Figures, for parts experiencing a complex-tension state—stretching-compression, bending, twisting, crumbling, shearing—fine-modules (<3 mm) gear teeth, splined shafts, thin-wall bushings, car girder frames and parts of ball bearings with a wall thickness of less than 8 mm.

Thermo-physical calculation results shown on the graphs (see the Figures) are made more precise by experimental research, and characterize the hardened layer depth (Δ) obtained during LH and SH steel hardening depending on a specific cylinder (sphere) diameter (D) or plate thickness (δ) and the ideal critical diameter (DI) of steel over a wide range of values.

As far as crack formation is concerned, practical research indicates that for all steels with the actual austenite grain not coarser than #11 mentioned herein, crack formation does not take place. This is true with respect to both surface-hardened sections of the part with compression residual stresses within the hardened layer that lower the sensitivity to crack formation, and separate zone with through-depth hardening (thin splines, thread, keyslots, end faces of thin bushings, etc.) with stretching residual local tension stresses in the surface layers, that greatly contribute to crack formation and propagation. This is because the tension stresses that occur during formation of fine-structure martensite are reliably offset by its high brittle strength.

For steels with 0.15-0.30% carbon content, due to lower tensile strength of the low-carbon martensite featuring some plasticity even in the untempered state, experimental research made it possible to expand the range of the actual austenite grain growth to #6 size, where cracks are not present.

For steels with a higher carbon content (>0.3%), with no local sections in parts with through-depth hardening, the maximum actual austenite grain size at which crack formation does not take place corresponds to #8, provided that the steel was self-tempered at 150-300° C. for 1.0-0.30 sec.

For relatively massive parts (i.e., greater than 1(00 mm in diameter) made from steels with increased carbon content, single-, double- or triple self-tempering is recommended for reliable prevention of crack formation.

Low tempering while heating in a furnace at 150-300° C. is performed to ensure final stabilization of the steel part microstructure and properties.

Medium and high furnace tempering of parts may also be carried out at temperatures over 300° C., i.e. above temperatures at which martensite totally decomposes within the surface-hardened layer into a thin quasi-eutectoid structure—troostite, troostosorbite, temper sorbite with HRC 25-50, and preserving the perlite-sorbite hardening structure in the core. This tempering is carried out for parts requiring a combination of strength, higher plasticity properties and surface impact strength—shafts, axles and similar parts.

Tables 1-3 list chemical compositions of LH and SH steels with their ideal (critical) diameters and examples of results obtained from execution of the proposed process.

Example 1

LH steel with the following chemical composition; %: 0.78 C; 0.04 Mn; 0.08 Si; 0.07 Cr; 0.15 Ni; 0.08 cr; 0.04 Al; 0.15 Ti; 0.015 S; 0.018 P has calculated DI=7.8 mm when treated for #12 grain size. According to the graphs (see Figures), hardening per the proposed process should result in formation of a 1.4 mm hardened layer on a flat plate or 8-mm wall cylinder-shaped bushing.

An 8-mm wall roller bearing ring made from this steel was through-heated in an induction furnace up to 850° C. for 20 sec and then subjected to cooling with a sharp water shower and tempered in a furnace at 150° C. with soaking for 2 hours.

As a result, the hardened layer on the outer and inner surfaces of the ring was 1.7 mm and 0.5 mm, i.e. 18.2 of the wall thickness, which corresponds to the through-surface hardening (TSH); the hardened layer microstructure was cryptocrystalline martensite (#1 grain size), hardness was HRC65-66, in the core—troosite, troostosorbit, sorbite with HRC 38-45 hardness.

Example 2

SH steel with the following chemical composition %: 0.61 C; 0.5 Mn; 0.08 Si; 0.13 Cr; 0.25 Ni; 0.03 Cu; 0.04 Al; 0.05 Ti; 0.015 S; 0.018 P has a calculated DI=22.5 mm when treated for #11 grain size. According to the graph (see FIG. 1B, 2A), hardening of this steel by the process of the invention should result in formation of a 5 mm thick hardened layer on a 45 mm dia cylindrical rod and a 12-14 mm thick hardened layer on a 30 m dia sphere.

A 45 mm dia cylindrical center pin made from this steel was through-heated in an induction furnace up to 900° C. for 50 seconds and then subjected to cooling with a sharp water flow and tempered in a furnace at 180° C. with soaking for 2 hours. As a result, the hardened layer depth on the part surface was 5 mm, i.e. 0.11 of the diameter, which corresponds to the graph (see FIG. 1*b*); the hardened layer microstructure was fine-needled martensite (#2 grain size), hardness was HRC56, in the core—troostite, troostosorbit, sorbite with HRC30-40 hardness.

A 30 mm dia grinding ball made from this steel was through-heated in a furnace up to 850° C. and then subjected to cooling with a sharp water flow with self-tempering at 180° C. for 5 seconds, followed by final cooling with a water flow. As a result, the hardened layer on the part surface was 12 mm, i.e. 0.4 of the diameter, which corresponds to hardening close to through-depth hardening and to FIG. 2A graph; the hardened layer microstructure was fine-needled martensite (#2 size, #11 grain size), hardness was HRC64, in the core—troostosorbite with HRC48-50 hardness.

Example 3

SH Steel with the following chemical composition, %; 0.5 C; 0.1 Mn; 0.15 Si; 1.0 Cr; 0.8 Ni; 0.03 Cu; 0.05 Al; 0.35 V; 0.5 W; 0.015 S; 0.018 P has a calculated DI=47 mm when treated for #10 grain size. According to the graph (see FIG. 3B), hardening of this steel by the process of the invention should result in formation of a 9 mm hardened layer on a 150 mm thick plate.

A 150×200×200 mm parallelepiped-shaped part made from this steel was through-heated in a furnace up to 850° C. and then subjected to cooling with a sharp water flow with double self-tempered at 180° C. for 5 seconds, followed by final cooling with a water flow and tempering in a furnace at 450° C. with soaking for 3 hours. As a result, the hardened layer along the part surface perimeter was 9 mm, i.e. 0.06 of the thickness (150 mm), which corresponds to the FIG. 3B graph; the microstructure of the hardened layer was in the form of temper troositite, hardness was RC48, in the core—hardened troostosorite, hardness HRC 48-50.

TABLE 3

| Alloyed SH steels | | | | | | | | | | | | | | |
|---|---|---|---|---|---|---|---|---|---|---|---|---|---|---|
| C | Mn | Si | Cr | Ni | Cu | Al | Ti | V | Mo | W | S | P | Grain | $D_{CI}$ |
| 0.50 | 0.10 | 0.95 | 0.80 | 0.10 | 0.01 | 0.05 | 0.10 | 0.25 | — | — | 0.022 | 0.027 | 12 | 25.5 |
| 0.50 | 0.10 | 0.95 | 0.80 | 0.10 | 0.01 | 0.05 | 0.10 | 0.25 | — | — | 0.022 | 0.027 | 10 | 29.7 |
| 0.50 | 0.10 | 0.15 | 0.75 | 1.80 | 0.20 | 0.05 | 0.40 | — | — | 0.70 | 0.025 | 0.030 | 10 | 44.1 |
| 0.50 | 0.12 | 0.15 | 1.80 | 1.00 | 0.18 | 0.05 | 0.10 | 0.38 | 0.50 | — | 0.017 | 0.020 | 10 | 95.6 |
| 0.80 | 0.11 | 0.12 | 0.80 | 0.30 | 0.25 | 0.05 | 0.10 | 0.35 | — | 0.80 | 0.032 | 0.033 | 12 | 46.5 |

TABLE 3-continued

| Alloyed SH steels | | | | | | | | | | | | | | |
|---|---|---|---|---|---|---|---|---|---|---|---|---|---|---|
| C | Mn | Si | Cr | Ni | Cu | Al | Ti | V | Mo | W | S | P | Grain | $D_{CI}$ |
| 0.80 | 0.15 | 0.08 | 1.20 | 0.08 | 0.15 | 0.05 | 0.20 | — | 0.40 | 1.20 | 0.025 | 0.029 | 11 | 174.8 |
| 0.80 | 1.10 | 1.00 | 1.15 | 0.15 | 0.12 | 0.06 | 0.15 | — | — | — | 0.027 | 0.031 | 12 | 194.0 |
| 1.20 | 0.11 | 0.12 | 0.80 | 0.30 | 0.25 | 0.05 | 0.10 | 0.35 | — | — | 0.032 | 0.033 | 12 | 43.6 |
| 1.20 | 0.15 | 0.08 | 1.20 | 0.08 | 0.15 | 0.05 | 0.20 | — | 0.40 | 1.20 | 0.025 | 0.029 | 12 | 143.4 |
| 1.20 | 1.10 | 1.00 | 1.15 | 0.15 | 0.12 | 0.06 | 0.15 | — | — | — | 0.027 | 0.031 | 12 | 160.1 |

TABLE 1

| Carbon LH steels | | | | | | | | | | | | | | |
|---|---|---|---|---|---|---|---|---|---|---|---|---|---|---|
| C | Mn | Si | Cr | Ni | Cu | Al | Ti | V | Mo | B | S | P | Grain | $D_{CI}$ |
| 0.15 | 0.15 | 0.08 | 0.15 | 0.15 | 0.20 | 0.05 | 0.10 | — | — | — | 0.028 | 0.032 | 12 | 5.0/6.2 |
| 0.15 | " | " | " | " | " | " | " | — | — | — | | | 10 | 5.8/6.5 |
| 0.15 | " | " | " | " | " | " | " | | | | | | 6 | 7.9/8.5 |
| 0.15 | 0.40 | 0.15 | 0.20 | 0.15 | 0.10 | 0.05 | 0.10 | — | — | — | 0.025 | 0.030 | 11 | 11.5/12.0 |
| 0.15 | " | " | " | " | " | " | " | — | — | — | | | 6 | 15.6/16.0 |
| 0.80 | 0.03 | 0.05 | 0.02 | 0.10 | 0.15 | 0.05 | 0.22 | — | — | 0.005 | 0.03 | 0.030 | 12 | 6.5/6.9 |
| 0.80 | " | " | " | " | " | " | " | — | — | — | | | 10 | 7.5/8.1 |
| 0.80 | " | " | " | " | " | " | " | — | — | — | | | 8 | 8.9/9.5 |
| 0.81 | 0.16 | 0.15 | 0.08 | 0.03 | 0.15 | 0.05 | 0.10 | — | — | — | 0.028 | 0.032 | 11 | 12.3/12.0 |
| 0.78 | 0.15 | 0.09 | 0.20 | 0.30 | 0.28 | 0.04 | — | 0.12 | — | — | 0.025 | 0.021 | 12 | 15.1/15.8 |
| 1.20 | 0.08 | 0.05 | 0.10 | 0.08 | 0.12 | 0.06 | 0.15 | — | — | — | 0.018 | 0.023 | 12 | 7.6/7.7 |
| 1.20 | 0.08 | 0.05 | 0.10 | 0.08 | 0.12 | 0.06 | 0.15 | — | — | — | 0.018 | 0.023 | 8 | 10.3/11.0 |
| 1.20 | 0.38 | 0.05 | 0.14 | 0.16 | 0.06 | 0.05 | — | 0.15 | — | — | 0.025 | 0.030 | 12 | 16.2/15.5 |

TABLE 2

| Carbon and low-alloyed SH steels | | | | | | | | | | | | | | |
|---|---|---|---|---|---|---|---|---|---|---|---|---|---|---|
| C | Mn | Si | Cr | Ni | Cu | Al | Ti | V | Mo | B | S | P | Grain | $D_{CI}$ |
| 0.25 | 0.50 | 0.80 | 0.08 | 0.12 | 0.30 | 0.05 | 0.20 | — | — | — | 0.025 | 0.027 | 12 | 17.3 |
| 0.25 | 0.50 | 0.80 | 0.08 | 0.12 | 0.30 | 0.05 | 0.20 | — | — | — | 0.025 | 0.027 | 10 | 20.0 |
| 0.25 | 0.50 | 0.80 | 0.08 | 0.12 | 0.30 | 0.05 | 0.20 | — | — | — | 0.025 | 0.027 | 6 | 27.2 |
| 0.25 | 1.80 | 1.80 | 0.08 | 0.12 | 0.30 | 0.05 | 0.20 | — | — | — | 0.025 | 0.027 | 11 | 73.3 |
| 0.25 | 1.80 | 1.80 | 0.08 | 0.12 | 0.30 | 0.05 | 0.20 | — | — | 0.004 | 0.025 | 0.027 | 11 | 145.1 |
| 0.80 | 0.50 | 0.80 | 0.08 | 0.12 | 0.30 | 0.05 | 0.20 | — | — | — | 0.025 | 0.027 | 12 | 31.15 |
| 0.80 | 0.50 | 0.80 | 0.08 | 0.12 | 0.30 | 0.05 | 0.20 | — | — | — | 0.025 | 0.027 | 11 | 33.64 |
| 0.80 | 0.50 | 0.80 | 0.08 | 0.12 | 0.30 | 0.05 | 0.20 | — | — | — | 0.025 | 0.027 | 8 | 42.46 |
| 0.80 | 0.30 | 0.20 | 0.08 | 0.12 | 0.30 | 0.05 | 0.20 | — | — | — | 0.025 | 0.027 | 12 | 17.1 |
| 0.80 | 1.80 | 1.80 | 0.08 | 0.12 | 0.30 | 0.05 | 0.20 | — | — | — | 0.025 | 0.027 | 12 | 122.6 |
| 1.20 | 1.80 | 1.80 | 0.08 | 0.12 | 0.30 | 0.05 | 0.20 | — | — | — | 0.025 | 0.027 | 12 | 100.5 |
| 1.20 | 1.80 | 1.80 | 0.08 | 0.12 | 0.30 | 0.05 | 0.20 | — | — | — | 0.025 | 0.027 | 10 | 117.0 |
| 1.20 | 1.80 | 1.80 | 0.08 | 0.12 | 0.30 | 0.05 | 0.20 | — | — | — | 0.025 | 0.027 | 8 | 136.4 |

The invention claimed is:

1. A process for obtaining a particular depth of hardening of a contoured steel part comprising:

limiting each of the content of the following alloy elements in steel from which the part is to be made to the weight percentages as follows:

| | |
|---|---|
| Carbon | .15-1.2 |
| Manganese | not more than 1.8 |
| Silicon | not more than 1.8 |
| Chrome | not more than 1.8 |
| Nickel | not more than 1.8 |
| Molybdenum | not more than .5 |
| Tungsten | not more than 1.5 |
| Boron | not more than .007 |
| Copper | not more than .3 |
| Aluminum | .03-0.1 |

-continued

| | |
|---|---|
| Titanium | not more than .4 |
| Vanadium | not more than .4 |
| Nitrogen | not more than .1 |
| Zireonium | not more than .4 |
| Calcium | not more than .03 |
| Sulphur | not more than .035 |
| Phosphorus | not more than .035 |

determining the Ideal Diameter (D1) which will produce the particular depth of hardening on a part when through surface quenched at a rate more than 40,000 kcal/m$^2$·H ° C.;

adding alloying elements to modify said steel from which the part is to be made so as to establish said D1 value of the steel from which the part is to be made according to the following formula:

$$DI=K\cdot\sqrt{C}\cdot(1+4,1\cdot Mn)\cdot(1+0,65\cdot Si)\cdot(1+2,33\cdot Cr)\cdot(1+0,52\cdot Ni)\cdot(1+),27\cdot Cu)\cdot(1+3.14\cdot Mo)(1+1.05\cdot W)\cdot[1+1.5(0.9-C]\cdot(1-0.45C')\cdot(1-0.3Ti)\cdot(1-0.35V)\cdot(1-0.25Al),$$

wherein DI is the ideal diameter, in mm;

wherein K is the coefficient whose value depends on the actual austenite grain size ##6-13 according to the ASTM scale, GOST5639, and is, respectively, equal to: 5.4 for #13 grain; 5.8 for #12 grain; 6.25 for #11 grain; 6.75 for #10 grain; 7.3 for #9 grain; 7.9 for #8 grain; 8.5 for #7 grain; 9.2 for #6 grain; and, wherein the C, Mn, Si, Cr, Ni, Cu, Mo, W components, are limited to said weight % limits, and in the austenite solid solution at the final heating temperature preceding quenching cooling; and wherein [1+1.5(0.9-C] is the multiplicand taken into account only if boron is present in steel of the part in the amount of 0.002-0.007 by weight %;

wherein C', Ti, V, Al are components by weight %, which are not contained in the austenite solid solution, but present in the form of structurally-free secondary carbonitride phases at the final heating temperature preceding hardening cooling, in which case C' is the weight % of carbon content in excessive hypereutectoid steel cemenite;

making the part from the further alloyed steel;

heating the part so made by through surface heating of the part to the temperature of austenitization; and, quenching said heated part at a rate of more than 40,000 kcal/m$^2$·H ° C. to thereby harden said part to said particular depth.

2. The process according to claim 1 wherein to prevent hot-brittleness, the total content of manganese and titanium in the steel is more than six times the maximum sulfur content.

3. The process according to claim 1 wherein the composition of the steel of the part contains carbon in the amount of >0.3 weight % to prevent hardening cracks, and said part is heated to ensure the actual austenite grain size is not greater than #6.

4. The process according to claim 1 wherein the steel of the part contains carbon in the amount of >0.3 weight % to prevent hardening cracks, and is heated to ensure the actual austenite grain size is not greater than #11.

5. A process for making a steel part having a cylindrical, spherical or plate shape and of a particular diameter and/or thickness and, hardened to a particular intended depth, comprising:

referring to the graphs of FIGS. 1-7 to identify a Dcr line which traverses across a point which corresponds to the selected part shape and diameter thickness, and the intended hardening depth;

making said part of a steel in which the following listed elements are limited in weight % as indicated:

| | |
|---|---|
| Carbon | .15-1.2 |
| Manganese | not more than 1.8 |
| Silicon | not more than 1.8 |
| Chrome | not more than 1.8 |
| Nickel | not more than 1.8 |
| Molybdenum | not more than .5 |
| Tungsten | not more than 1.5 |
| Boron | not more than .007 |
| Copper | not more than .3 |
| Aluminum | .03-0.1 |
| Titanium | not more than .4 |
| Vanadium | not more than .4 |

-continued

| | |
|---|---|
| Nitrogen | not more than .1 |
| Zireonium | not more than .4 |
| Calcium | not more than .03 |
| Sulphur | not more than .035 |
| Phosphorus | not more than .035 |

said steel of a composition which produces a Dcr corresponding to said located Dcr plot as calculated by the following formula:

$$Dcr=K\cdot\sqrt{C}\cdot(1+4,1\cdot Mn)\cdot(1+0,65\cdot Si)\cdot(1+2,33\cdot Cr)\cdot(1+0,52\cdot Ni)\cdot(1+),27\cdot Cu)\cdot(1+3.14\cdot Mo)(1+1.05\cdot W)\cdot[1+1,5(0,9-C]\cdot(1-0,45C')\cdot(1-0,3Ti)\cdot(1-0,35V)\cdot(1-0,25Al),$$

wherein Dcr is the ideal diameter, in mm, and wherein K is the coefficient whose value depends on the actual austenite grain size ##6-13 according to the ASTM scale, GOST5639, and is, respectively, equal to: 5.4 for #13 grain; 5.8 for #12 grain; 6.25 for #11 grain; 6.75 for #10 grain; 7.3 for #9 grain; 7.9 for #8 grain; 8.5 for #7 grain; 9.2 for #6 grain; and, wherein the C, Mn, Si, Cr, Ni, Cu, Mo, W components', are limited to by weight % limits, and of the austenite solid solution at the final heating temperature preceding quenching cooling; and wherein [1+1.5(0.9-C] is the multiplicand taken into account only if boron is present in steel of the part in the amount of 0.002-0.007 by weight %;

wherein C', Ti, V, Al are components by weight %, are not contained in the austenite solid solution, but present in the form of structurally-free secondary carbonitride phases at the final heating temperature preceding hardening cooling, in which case C' is the weight % of carbon content in excessive hypereutectoid steel cemenite;

wherein the steel of the part contains carbon in the amount of >0.3 weight % to prevent hardening cracks, and is heated to ensure the actual austenite grain size is not greater than #8, and cooling is done with self-tempering at 150-300° C. for 1.0-30 seconds hardening the part so composed by through surface heating of the part to the temperature of austenitization; and quenching said heated part at a rate of more than 40,000 kcal/m$^2$·H ° C., and, thereafter tempering said part.

6. A process for making a steel part having a cylindrical, spherical or plate shape and of a particular diameter or thickness and, hardened to a particular intended depth, comprising:

referring to the graphs of FIGS. 1-7 to identify a Dcr line which traverses across a point which corresponds to the selected part shape and diameter thickness, and the intended hardening depth;

making said part of a steel in which the following listed elements are limited in weight % as indicated:

| | |
|---|---|
| Carbon | .15-1.2 |
| Manganese | not more than 1.8 |
| Silicon | not more than 1.8 |
| Chrome | not more than 1.8 |
| Nickel | not more than 1.8 |
| Molybdenum | not more than .5 |
| Tungsten | not more than 1.5 |
| Boron | not more than .007 |
| Copper | not more than .3 |
| Aluminum | .03-0.1 |

-continued

| | |
|---|---|
| Titanium | not more than .4 |
| Vanadium | not more than .4 |
| Nitrogen | not more than .1 |
| Zireonium | not more than .4 |
| Calcium | not more than .03 |
| Sulphur | not more than .035 |
| Phosphorus | not more than .035 |

said steel of a composition which produces a Dcr corresponding to said located Dcr plot as calculated by the following formula:

$$Dcr=K\cdot\sqrt{C}\cdot(1+4,1\cdot Mn)\cdot(1+0,65\cdot Si)\cdot(1+2,33\cdot Cr)\cdot(1+0,52\cdot Ni)\cdot(1+),27\cdot Cu)\cdot(1+3.14\cdot Mo)(1+1.05\cdot W)\cdot[1+1,5(0,9-C]\cdot(1-0,45C')\cdot(1-0,3Ti)\cdot(1-0,35V)\cdot(1-0,25Al),$$

wherein Dcr is the ideal diameter (DI), in mm, and wherein K is the coefficient whose value depends on the actual austenite grain size ##6-13 according to the ASTM scale, GOST5639, and is, respectively, equal to: 5.4 for #13 grain; 5.8 for #12 grain; 6.25 for #11 grain; 6.75 for #10 grain; 7.3 for #9 grain; 7.9 for #8 grain; 8.5 for #7 grain; 9.2 for #6 grain; and, wherein the C, Mn, Si, Cr, Ni, Cu, Mo, W components', are limited to by weight % limits, and of the austenite solid solution at the final heating temperature preceding quenching cooling; and wherein [1+1.5(0.9-C] is the multiplicand taken into account only if boron is present in steel of the part in the amount of 0.002-0.007 by weight %;

wherein C', Ti, V, Al are components by weight %, are not contained in the austenite solid solution, but present in the form of structurally-free secondary carbonitride phases at the final heating temperature preceding hardening cooling, in which case C' is the weight % of carbon content in excessive hypereutectoid steel cementite;

hardening the part so composed by through surface heating of the part to the temperature of austenitization; and quenching said heated part at a rate of more than 40,000 kcal/$m^2$·H ° C., and, thereafter tempering said part;

wherein the steel of the part contains carbon in the amount of >0.3 weight % to prevent hardening cracks, and is heated to ensure the actual austenite grain size is not greater than #8, and cooling is done with self-tempering at 150-300° C. for 1.0-30 seconds.

* * * * *